US005346323A

United States Patent [19]

Harris et al.

[11] Patent Number: 5,346,323

[45] Date of Patent: * Sep. 13, 1994

[54] PUSH-UP PACKAGE

[75] Inventors: Dennis Harris, Scottsdale; Ronald General, Phoenix, both of Ariz.

[73] Assignee: GHS Products, Inc., Phoenix, Ariz.

[ * ] Notice: The portion of the term of this patent subsequent to Feb. 15, 2011 has been disclaimed.

[21] Appl. No.: 103,276

[22] Filed: Aug. 6, 1993

Related U.S. Application Data

[63] Continuation-in-part of Ser. No. 958,698, Oct. 9, 1992, Pat. No. 5,286,126.

[51] Int. Cl.[5] ..... A45D 40/02

[52] U.S. Cl. ..... 401/82; 401/87; 401/88; 401/98

[58] Field of Search ..... 401/82, 84, 85, 88, 401/98, 52, 87

[56] References Cited

U.S. PATENT DOCUMENTS 1,969,331 8/1934 Small .
2,509,536 5/1950 Spender .
2,626,847 1/1953 Brown ..... 49/82 X
4,023,912 5/1977 Mahler .
4,139,311 2/1979 Lorscheidt .
4,621,935 11/1986 Sussman .

FOREIGN PATENT DOCUMENTS 681439 10/1952 United Kingdom .

*Primary Examiner*—Danton D. DeMille
*Attorney, Agent, or Firm*—LaValle D. Ptak

[57] ABSTRACT

A package for dispensing solid products, such as solid crystal deodorant, includes a first hollow main body portion having a uniform cross section throughout its length. Both ends of the package are open; and a slide member is located within the main body portion. The bottom end of the main body portion of the package has an inwardly turned flange to prevent the movement of the slide member outwardly from the main body portion through the bottom end. The solid crystal deodorant is mounted on the slide member, and is configured to freely move from the bottom end of the main body portion outwardly through the upper end. Drain holes are placed through the slide member to permit fluid, such as water, to pass downwardly from the sides of the crystal deodorant and out through the holes when the package is stored in an upright position. A chamber in the slide member is filled with a sponge-like material for receiving fluid which passes from the crystal deodorant through the holes in the slide member.

14 Claims, 1 Drawing Sheet

PUSH-UP PACKAGE

RELATED APPLICATION

This application is a continuation-in-part of application Ser. No. 07/958,698 filed on Oct. 9, 1992, now U.S. Pat. No. 5,286,126.

BACKGROUND

A number of personal care products, which are solid at room temperature, are packaged in tubular containers constructed to expose a small amount of the product at the open upper end of the container. Typically, these containers have a cap over the open end to enclose the product when it is stored or not in use. Products of this type typically are lipstick, stick deodorant, eye color, facial blushes and the like. The typical containers for these products usually have the product attached to or mounted on a lower platform, which is moved up and down in the main hollow container by means of a rotational screw-like apparatus. The product is moved upwardly beyond the upper edge of the main container when it is to be used. Some of these containers permit the product to be retracted back into the container when it is not in use. Most products of the type mentioned above, while they are solid at room temperature, are somewhat soft gels, of a wax-like consistency. Such products comprise colloidal solutions which have set into semi-solid jellies.

Three patents which are directed to packages for gel-type deodorant sticks and lipsticks are the U.S. patents to Small U.S. Pat. No. 1,969,331 and Lorscheidt U.S. Pat. No. 4,139,311, and the British patent specification No. 681,439. These three patents all are directed to "push-up" dispensers for either deodorant or lipstick, in which a piston is mounted inside an elongated cylinder for movement within the cylinder. The deodorant gel or lipstick then is carried by the piston, which may be pushed upwardly out of the cylinder from the open bottom of the cylindrical container to present the deodorant stick gel or lipstick for application.

None of the products of the prior art, which are mentioned above and which are known to applicant, however, are intended to be wetted with water prior to their use. Most of them contain a substantial amount of moisture, inherently bound into the product; so that external application of water to permit use of the product is not required.

In the field of personal deodorants, however, solid rock-like crystal deodorants are gaining increasing acceptance. In contrast to gels, crystals comprise mineral bodies which have a regular repeating, interlinked molecular, geometric form. These crystal deodorants are made in a variety of shapes, typically from postassium alum, ammonium alum or other similar alum salts, the molecular structure of which has assumed a regular, repetitive interlinked geometric form. They are hard and somewhat brittle. To use such crystal deodorants, the user either immerses them briefly in water, or places them under running water from a tap. The crystal then is rubbed over the area of the body to which the deodorant is to be applied. After use, the still wet crystal typically is placed on a sponge or in a storage container, where it is allowed to dry out. When such crystal deodorants are wet, they tend to be somewhat slippery, and sometimes slip out of the hands of the user. Because they are brittle, if they fall onto a hard counter top surface or a hard floor, parts may chip off, or the crystal may shatter.

It is desirable to provide a push-up container for use with solid crystal deodorants, which overcomes the handling disadvantages of solid crystal deodorants and permits use of such deodorants in a uniquely designed push-up package.

SUMMARY OF THE INVENTION

It is an object of this invention to provide an improved package for solid products.

It is an additional object of this invention to provide an improved push-up package for dispensing product.

It is another object of this invention to provide an improved push-up package for solid products, such as solid crystal deodorants.

It is a further object of this invention to provide an improved push-up package for solid product, which has a provision for draining away moisture from the product after use.

In accordance with a preferred embodiment of the invention, a package for a solid product includes a hollow main body portion, which has a uniform cross section across its length. The main body portion of the package is open at least at one end; and a slide member is located within the body portion. The slide member is configured to permit movement in the main body portion from one end to the other. The main body portion of the package also is configured at one end to inhibit the slide member from moving past that one end; and the slide member is configured to permit fluid on a solid product carried by it to pass through the slide member.

DETAILED DESCRIPTION

Figure 1:
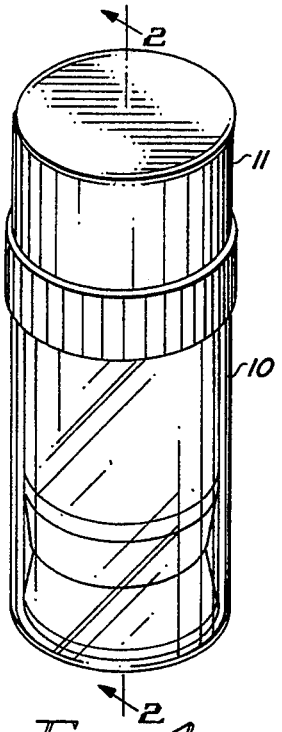
FIG. 1 is a perspective view of a container in accordance with a preferred embodiment of the invention.

Reference now should be made to the drawing, in which the same reference numbers are used in the different figures to designate the same components.

Figure 2:
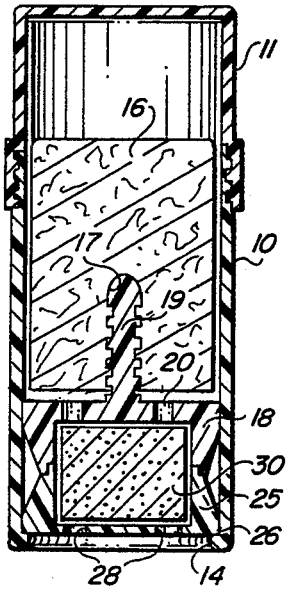
FIG. 2 is a cross-sectional view taken along the line 2—2 of FIG. 1.

FIG. 1 is a perspective view of a container which is used in conjunction with a preferred embodiment of the invention. The container comprises a lower, hollow cylindrical main body portion 10, which is closed at its top by a cap 11. In FIG. 2, a cross section of this embodiment shows details of the structure of both the package comprising the main body portion 10 and the cap 11, as well as the internal parts of the package, along with a cylindrically-shaped solid crystal deodorant 16, which is placed in the package. The crystal deodorant 16 typically is either potassium alum or ammonium alum.

Figure 3:
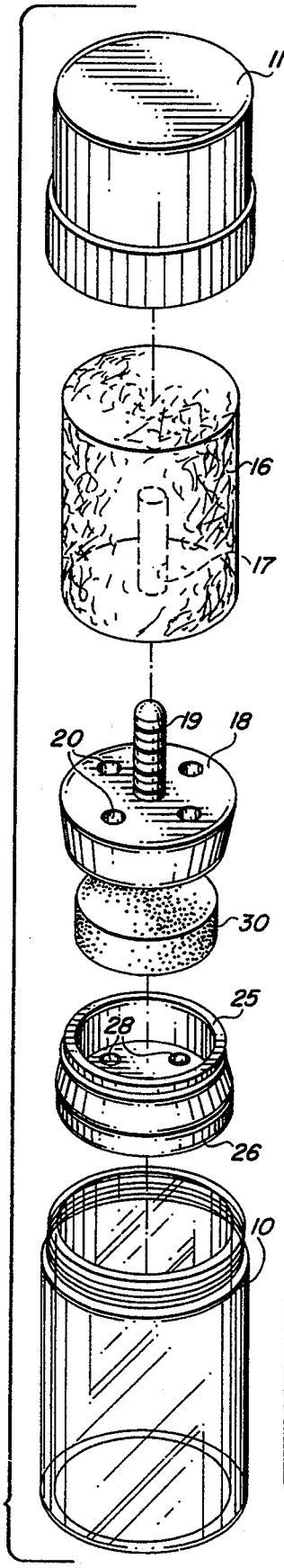
FIG. 3 is an exploded view of the embodiment shown in FIGS. 1 and 2.

The package shown in FIGS. 1, 2 and 3 is a "push-up" package; and the bottom of the cylinder 10 is open, with an inwardly turned flange 14 in it. The package includes a two-piece slide member comprised of an upper section 18 and a lower section 25, which fit together to form a hollow cavity in which a sponge 30 or other suitable water absorbent material is placed. At least the lower outer edge 26 of the lower portion 25 of the slide member frictionally engages the interior wall of the circular cylinder 10 to hold the slide member in place when it has been partially extended upward (as shown in FIGS. 1 and 2) in the housing 10.

The solid crystal deodorant cylinder 16 has a hole 17 located on its axis and extending part way into the cylinder 16 from the bottom. A frictional projection 19, which is integrally formed with the top portion 18 of the slide member, and which is longer than the depth of the hole 17 is forced into the hole 17 to hold the cylinder 16 in place spaced above the top surface of the upper part 18 of the slide member by a small amount.

As is well known, when a solid crystal deodorant, such as the deodorant 16, is used, it is first wetted with water by holding it under a running tap or immersing it in a sink filled with water. The deodorant then is used in a conventional manner by applying it to the body where it is desired. After use, the cap 11 typically is placed on the top of the cylinder 10; but the deodorant 16 still has excess water on it, which must be allowed to drain away from the deodorant 16 or dry out.

If water is left on the crystal 16, or if the crystal is permitted to have a portion submerged in water, it will eventually deteriorate by becoming soft. When this happens, the crystal 16 may be unusable for use in the manner intended. To prevent this from happening, the crystal cylinder 16 is spaced from the inner wall of the cylindrical body portion 10 to permit water to drain down the sides of the crystal 16 to the surface of the upper portion of the slide member 18. A number of holes 20 are formed through the top surface of the upper portion 18 of the slide member, and extend through the slide member 18 into the cavity in which the sponge 30 is located. A similar set of holes 28 are formed through the bottom of the lower part of the slide member 25; so that water may flow down the sides of the crystal cylinder 16, through the holes 20 and into the sponge 30.

If a relatively small amount of water passes through the holes 20 to the sponge 30, the sponge holds that water, which then is slowly evaporated through the holes 28; so that no puddling of water occurs beneath the hollow bottom of the cylinder 10 when the package is stored or not in use. If a relatively large amount of water, however, is present, it is possible for the sponge 30 to become saturated. When this occurs, the remainder of the water then flows outwardly through the holes 28. Also, if no sponge is used, the cavity in the slide member could be eliminated, and water flow through the holes 20 out of the slide member 18 and out of the package would take place. Of course, some puddling of water beneath the package would exist for such a structure. In either event, no puddling of the water on the bottom of the crystal deodorant cylinder 16 occurs; and it is preserved for repeated use.

It should be noted, from an examination of FIG. 2, that the cylinder 16 has an external diameter which is slightly less than the internal diameter of the cylinder 10. The distance between the external diameter of the crystal deodorant 16 and the internal diameter of the cylinder 10 forming the main body portion of the package is selected to be sufficient to permit water to pass downwardly past the outer edge of the cylinder 16 and onto the upper surface of the upper slide member portion 18.

The structure which is illustrated in FIGS. 2 and 3 is selected to employ sufficient frictional fit between the outer edges of the upper and lower portions 18 and 25 of the slide member to cause it to remain in place when it is pushed upwardly by a finger through the hole in the bottom of the cylinder 10 by applying pressure to the bottom of the lower portion 25 of the slide member. By applying pressure to the top of the crystal deodorant cylinder 16, the entire block may be depressed downwardly into the cylinder 10 until the outer edge 26 of the member 25 engages the flange 14. The flange 14 then prevents the slide member 18/25 from being pushed out of the main body portion 10 through the bottom, as viewed in FIGS. 1, 2 and 3.

Figure 4:
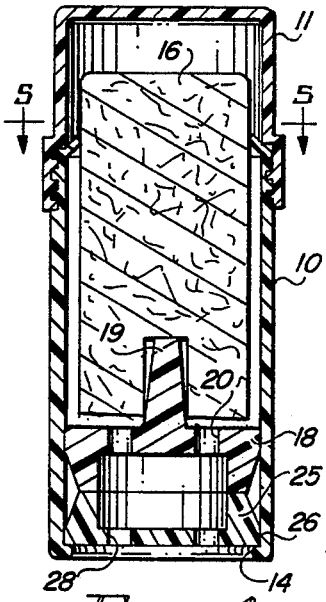
FIG. 4 is a cross-sectional view of an alternative to the embodiment shown in FIG. 2.
Figure 5:
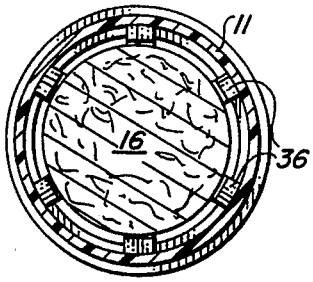
FIG. 5 is a cross-sectional view taken along the line 5—5 of FIG. 4.

Reference now should be made to FIG. 4, which is a variation of the device shown in FIG. 2. The device of FIG. 4 is identical to the one of FIG. 2, with the exception that a number of short, inwardly turned fingers 36 are placed around the upper edge of the cylinder 10 and extend inwardly and upwardly at an angle toward the central axis of the package. These fingers 36 engage the sides of the crystal deodorant cylinder 16 to cause it to be centrally positioned in the cylinder 10 as it is pushed upwardly in the manner described previously. The fingers 36, however, also tend to inhibit downward motion as a result of pressure applied to the top of the crystal deodorant cylinder 16. Thus, once the deodorant 16 has been pushed upwardly to some position past the resilient fingers 36, it is held in place by the fingers 36, and cannot be pushed back down toward the bottom of the main body portion 10 of the package unless substantial force is applied to it. In all other respects, the embodiment of FIGS. 4 and 5 operates in the same manner as the embodiment of FIGS. 1 through 3, described above.

Figure 6:
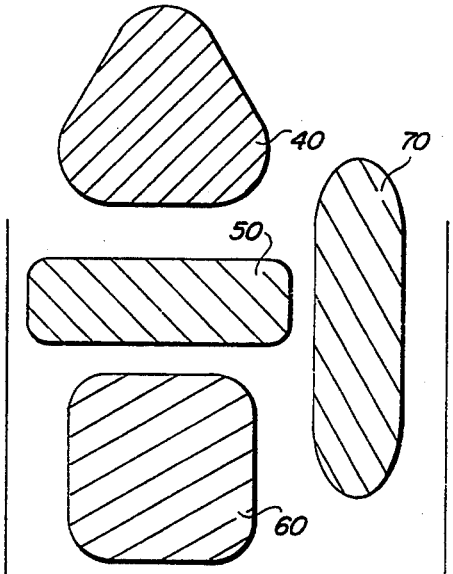
FIG. 6 is a grouping of alternative shapes, which may be used in place of the shapes of the embodiments shown in FIGS. 1 through 5.

It is to be noted that the internal diameter of the cylinder 10 and the external diameter of the crystal deodorant 16 both are of uniform cross section throughout their length. This permits the slide member 18/25 to be moved from the lowermost location, shown in FIGS. 2 and 4, to its uppermost location out of the top open end of the main body portion 10, with substantially the same frictional force throughout its distance of travel. It is not necessary, however, for the main body portion 10 and the crystal deodorant 16 to be of circular cross section. FIG. 6 illustrates four other possible cross-sectional configurations 40, 50, 60 and 70, which may be used in place of the circular cross-sectional configuration which is illustrated in FIGS. 1 through 5.

The foregoing description of the preferred embodiment of the invention is to be considered illustrative, and not as limiting. For example, the liquid which to drains from the crystal 16 into the cavity 30 may drain through grooves around the outside edge of the upper portion 18 of tile slide member, in place of the holes 20 which have been shown. In addition, the number of holes 20 and 28 which are illustrated can be varied in accordance with the particular design objectives for a specific application of the invention. In addition, while the sponge 30 performs a useful function, it could be eliminated; and any water draining from the crystal could be permitted to drain outwardly from the open bottom of the hollow main housing member 10. Other changes and modifications will occur to those skilled in the art, without departing from the true scope of the invention.

We claim:

1. A solid crystal deodorant product and package including in combination:

a hollow main body portion having first and second ends and having a uniform cross section across the length thereof between said first and second ends, said main body portion open on at least at the first end thereof;

a slide member located within and frictionally engaging the interior of said main body portion and configured to permit movement therein from the second end of said main body portion to the first end thereof;

blocking means at the second end of said main body portion for inhibiting said slide member from moving past the second end of said main body portion;

a solid crystal deodorant product;

means on said slide member for holding said solid crystal deodorant product thereon for movement therewith within said main body portion, with said crystal deodorant product spaced from said main body portion to permit fluid to flow therebetween during use of said package and spaced from said slide member to permit fluid to flow between said crystal deodorant and said slide member; and aperture means in said slide member for permitting the passage of fluid therethrough to the second end of said main body portion during use of said package.

2. The combination according to claim 1 further including a removable cap for the first end of said main body position.

3. The combination according to claim 1 wherein the second end of said main body portion is open.

4. The combination according to claim 3 wherein the opening in the second end of said main body portion is large enough to permit the insertion of the finger of a person therein to move said slide member toward the first end of said main body portion away from the second end thereof.

5. The combination according to claim 4 further including a removable cap for the first end of said main body portion.

6. The combination according to claim 5 wherein said blocking means comprises an inwardly turned flange on said second end of said main body portion.

7. The combination according to claim 1 further including additional means located adjacent the first end of said main body portion for engaging said solid crystal deodorant product held on said slide member to impede the movement of said product from the first end of said main body portion toward the second end thereof, while permitting movement of said product from the second end of said main body portion toward the first end thereof.

8. The combination according to claim 7 wherein said additional means comprises flexible means extending angularly inwardly toward the hollow interior of said main body portion to engage the surface of solid product passed therethrough.

9. The combination according to claim 8 wherein the second end of said main body portion is open.

10. The combination according to claim 9 wherein said blocking means comprises an inwardly turned flange on said second end of said main body portion.

11. The combination according to claim 1 wherein the second end of said main body portion is open.

12. The combination according to claim 11 wherein the opening in the second end of said main body portion is large enough to permit the insertion of the finger of a person therein to move said slide member toward the first end of said main body portion away from the second end thereof.

13. The combination according to claim 12 wherein said blocking means comprises an inwardly turned flange on said second end of said main body portion.

14. The combination according to claim 13 further including a removable cap for the first end of said main body portion.

* * * * *